US008123872B2

(12) United States Patent
Hazel et al.

(10) Patent No.: US 8,123,872 B2
(45) Date of Patent: Feb. 28, 2012

(54) CARBURIZATION PROCESS FOR STABILIZING NICKEL-BASED SUPERALLOYS

(75) Inventors: Brian Thomas Hazel, West Chester, OH (US); Ming Fu, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 1633 days.

(21) Appl. No.: 11/616,392

(22) Filed: Dec. 27, 2006

(65) Prior Publication Data

US 2010/0276036 A1 Nov. 4, 2010

Related U.S. Application Data

(63) Continuation-in-part of application No. 11/359,788, filed on Feb. 22, 2006, now Pat. No. 7,524,382.

(51) Int. Cl.
*C23C 8/20* (2006.01)
*C23C 8/80* (2006.01)

(52) U.S. Cl. ..... 148/206; 148/219; 148/537

(58) Field of Classification Search ..... 148/219, 148/206, 537
See application file for complete search history.

(56) References Cited

U.S. PATENT DOCUMENTS 4,321,311 A * 3/1982 Strangman ..... 428/623
5,127,967 A * 7/1992 Verhoff et al. ..... 148/222
5,270,123 A 12/1993 Walston et al.
5,334,263 A 8/1994 Schaeffer
5,427,866 A 6/1995 Nagaraj et al.
5,455,120 A 10/1995 Walston et al.
5,482,789 A 1/1996 O'Hara et al.
5,598,968 A 2/1997 Schaeffer et al.
5,695,821 A 12/1997 Murphy et al.
5,702,540 A 12/1997 Kubota
5,813,118 A * 9/1998 Roedl et al. ..... 29/889.1
5,891,267 A 4/1999 Schaeffer et al.
(Continued)

FOREIGN PATENT DOCUMENTS

EP 1598440 11/2005
(Continued)

OTHER PUBLICATIONS

ASM International, Materials Park, Ohio, Heat Treating, "Introduction to Surface Hardening of Steels", Aug. 1991, vol. 4, pp. 259-267.*

(Continued)

*Primary Examiner* — Jessee R. Roe
(74) *Attorney, Agent, or Firm* — William Scott Andes; Gary M. Hartman; Domenica N. S. Hartman

(57) ABSTRACT

A process by which a nickel-based superalloy substrate prone to deleterious reactions with an aluminum-rich coating can be stabilized by carburization. The process generally entails processing the surface of the substrate to be substantially free of oxides, heating the substrate in a non-oxidizing atmosphere to a carburization temperature, and then contacting the surface of the substrate with a carburization gas mixture comprising a diluted low activity hydrocarbon gas while maintaining the substrate at the carburization temperature. While at the carburization temperature and contacted by the carburization gas, carbon atoms in the carburization gas dissociate therefrom, transfer onto the surface of the substrate, diffuse into the substrate, and react with refractory metals within the substrate to form refractory metal carbides within a carburized region beneath the surface of the substrate. The substrate is then cooled in a non-oxidizing atmosphere to terminate carbide formation.

12 Claims, 3 Drawing Sheets

U.S. PATENT DOCUMENTS

| | | | | |
|---|---|---|---|---|
| 5,935,353 | A | 8/1999 | Murphy et al. | |
| 6,080,246 | A | 6/2000 | Wing | |
| 6,129,988 | A | 10/2000 | Vance et al. | |
| 6,299,896 | B1 | 10/2001 | Cooper et al. | |
| 6,306,524 | B1 | 10/2001 | Spitsberg et al. | |
| 6,444,053 | B1 | 9/2002 | Spitsberg et al. | |
| 6,447,932 | B1 | 9/2002 | O'Hara et al. | |
| 6,471,790 | B1 | 10/2002 | Fernihough | |
| 6,641,929 | B2 | 11/2003 | Kelly et al. | |
| 6,843,861 | B2 | 1/2005 | Grossman et al. | |
| 6,844,086 | B2 | 1/2005 | Grossman et al. | |
| 6,929,868 | B2 | 8/2005 | Kelly et al. | |
| 6,949,540 | B2 | 9/2005 | Cai et al. | |
| 7,524,382 | B2 * | 4/2009 | Fink et al. | 148/206 |
| 2002/0007877 | A1 | 1/2002 | Mihalisin et al. | |
| 2003/0075247 | A1 | 4/2003 | Koizumi et al. | |
| 2003/0148144 | A1 | 8/2003 | Gates, Jr. et al. | |
| 2004/0007296 | A1 | 1/2004 | Mihalisin et al. | |
| 2009/0197112 | A1 | 8/2009 | Fink et al. | |

FOREIGN PATENT DOCUMENTS

| | | |
|---|---|---|
| WO | WO20040104245 | 12/2004 |

OTHER PUBLICATIONS

ASM International, Materials Park, Ohio, Heat Treating, "Gas Carburizing", Aug. 1991, vol. 4, pp. 312-324.*

* cited by examiner

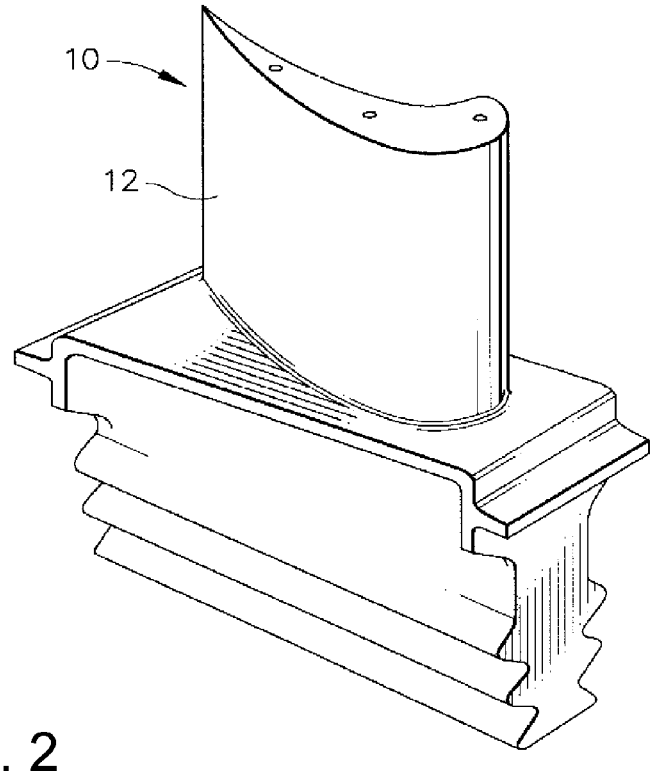
FIG. 1
FIG. 2
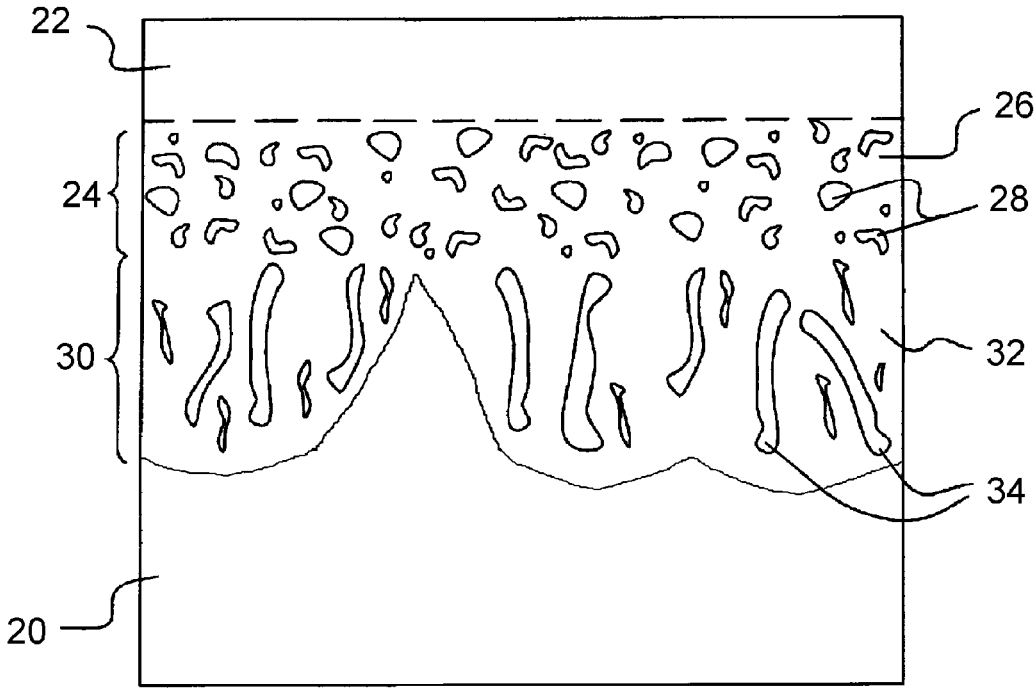

CARBURIZATION PROCESS FOR STABILIZING NICKEL-BASED SUPERALLOYS

CROSS REFERENCE TO RELATED APPLICATIONS

This application is a continuation-in-part patent application of U.S. patent application Ser. No. 11/359,788 (now U.S. Pat. No. 7,524,382), filed Feb. 22, 2006.

BACKGROUND OF THE INVENTION

The present invention generally relates to superalloys employed under service conditions involving extended exposures to high temperatures. More particularly, this invention is directed to a process for incorporating a carburized region beneath an aluminum-rich environmental coating on substrates formed of nickel-based superalloys prone to coating-induced metallurgical instability, wherein the carburized region stabilizes the microstructure of the substrate beneath the coating.

Certain components of gas turbine engines, particularly turbine blades, turbine vanes, and components of the combustor and augmentor, are susceptible to damage by oxidation and hot corrosion attack and are therefore protected by an environmental coating. If used in combination with a thermal barrier coating (TBC), the environmental coating is termed a bond coat and the combination of the TBC and environmental coating form what may be termed a TBC system. Environmental coatings in wide use include diffusion aluminide coatings formed by diffusing aluminum into the substrate to be protected, resulting in a coating on the substrate surface and a diffusion zone beneath the substrate surface. Examples are disclosed in U.S. Pat. Nos. 3,415,672, 3,540,878, 3,598,638, 3,617,360, 3,667,985, 3,677,789, 3,692,554, 3,819,338, 3,837,901, and 6,066,405. Other environmental coatings in use include overlay coatings such as MCrAlX (where M is iron, cobalt and/or nickel, and X is yttrium, rare earth metals, and/or reactive metals), and beta-phase (β) NiAl overlay coatings. Examples of the former are disclosed in commonly-assigned U.S. Pat. Nos. 5,043,138 and 5,316,866, and examples of the latter are disclosed in commonly-assigned U.S. Pat. Nos. 5,975,852, 6,153,313, 6,255,001, 6,291,084, and 6,620,524. The suitability of environmental coatings formed of NiAlPt to contain the gamma-prime phase (γ'-$Ni_3Al$ has also been considered, as disclosed in U.S. Patent Application Publication Nos. 2004/0229075 to Gleeson et al., 2006/0093801 to Darolia et al., and 2006/0093850 to Darolia et al.

Environmental coatings (with and without TBC) are being used in an increasing number of turbine applications, particularly on combustors, augmentors, turbine blades, turbine vanes, etc., of gas turbine engines. The material systems used for most turbine airfoil applications comprise a nickel-based superalloy as the substrate material, a platinum-modified diffusion aluminide (β-(Ni,Pt)Al) as the environmental coating (bond coat), and a zirconia-based ceramic as the TBC material. Yttria-stabilized zirconia (YSZ), with a typical yttria content in the range of about 4 to about 8 weight percent, is widely used as the ceramic material for TBC's. Common deposition processes include thermal spraying (particularly air plasma spraying) and physical vapor deposition (particularly electron-beam physical vapor deposition (EB-PVD)).

The above-noted environmental coating materials contain relatively high amounts of aluminum relative to the superalloys they protect, while superalloys contain various elements that are not present or are present in relatively small amounts in environmental coatings. During the deposition of an environmental coating, a primary diffusion zone of chemical mixing occurs to some degree between the coating and the superalloy substrate as a result of the concentration gradients of the constituents. Such a diffusion zone is particularly prominent in diffusion aluminide coatings. At elevated temperatures, further interdiffusion occurs as a result of solid-state diffusion across the substrate/coating interface. The migration of elements across this interface alters the chemical composition and microstructure of both the environmental coating and the substrate in the vicinity of the interface, causing what may be termed coating-induced metallurgical instability, sometimes deleterious results. For example, FIG. 2 represents a substrate region 20 of a nickel-based superalloy containing high levels, e.g., two weight percent or more, of refractory elements such as rhenium, chromium, tantalum, tungsten, and combinations thereof. The substrate region 20 is shown as being provided with a diffusion coating 22, such as an aluminide or a platinum (or other platinum group metal (PGM))-modified aluminide coating, which may optionally serve as a bond coat for a TBC (not shown). As represented in FIG. 2, a primary diffusion zone 24 is present in the substrate region 20 beneath the coating 22 as a result of the coating process. The diffusion zone 24 generally contains the beta (β-NiAl or β-(Ni,Pt)Al) matrix phase 26 of the coating 22 and refractory metal rich precipitation phases such as topologically close-packed (TCP) phases 28. The incidence of a moderate amount of the TCP phases 28 beneath the coating 22 is typically not detrimental. However, at elevated temperatures (including those during coating formation), further interdiffusion occurs as a result of solid-state diffusion across the substrate/coating interface. In particular, because of its high refractory metal content, a secondary reaction zone (SRZ) 30 is present beneath the diffusion zone 24. The SRZ 30 is characterized by a gamma/gamma-prime inversion relative to the substrate region 20, such that the SRZ 30 has a gamma prime (γ'-$Ni_3Al$) matrix 32 containing gamma (γ-Ni) and TCP-phase needles 34, which tend to be aligned perpendicular to the substrate-coating interface. SRZ 30 beneath the diffusion zone 24 can degrade mechanical properties of the superalloy substrate 20 by reducing the load-bearing cross-section or by crack initiation along the high angle grain boundary between the SRZ 30 and the superalloy substrate 20.

Commercially-known high strength superalloys that contain significant amounts of refractory elements (such as rhenium, chromium, tantalum, tungsten, hafnium, molybdenum, niobium, and zirconium) include gamma prime (γ') precipitate-strengthened nickel-based superalloys such as MX4 (U.S. Pat. No. 5,482,789), René N6 (U.S. Pat. No. 5,455,120), CMSX-10, CMSX-12, and TMS-75. Significant efforts have been put forth to control SRZ in these and other superalloys. For example, commonly-assigned U.S. Pat. Nos. 5,334,263, 5,891,267, and 6,447,932 provide for direct carburizing or nitriding of a superalloy substrate to form stable carbides or nitrides that tie up the high level of refractory metals present near the surface. Other proposed approaches involve blocking the diffusion path of aluminum into the superalloy substrate with a diffusion barrier coating, examples of which include ruthenium-based coatings disclosed in commonly-assigned U.S. Pat. Nos. 6,306,524 to Spitsberg et al., 6,720,088 to Zhao et al., 6,746,782 to Zhao et al., and 6,921,586 to Zhao et al. Still other attempts involve coating the surface of a high rhenium superalloy with chromides or cobalt prior to aluminizing the surface, as disclosed in U.S. Pat. No. 6,080,246. Finally, U.S. Pat. No. 5,427,866 to Nagaraj et al. discloses that a PGM-based coating diffused directly into a superalloy substrate can eliminate the need for a traditional aluminum-containing environmental coating and thereby avoid SRZ and TCP phase formation.

The ability to successfully inhibit SRZ formation by surface carburization was demonstrated in the above-noted U.S. Pat. Nos. 5,334,263 and 5,891,267. Surface carburization reacts TCP phase-forming elements (most notably rhenium, chromium, tantalum, and tungsten) with carbon to form submicron-sized carbides, to the extent that the incidence of TCP phases can be reduced and the microstructure of the substrate stabilized against formation of SRZ. FIG. 3 schematically represents a substrate region 20 (corresponding to that of FIG. 2) whose surface has been modified by carburization, and FIG. 4 contains an SEM photograph and a detail thereof showing a layer of submicron carbide precipitates formed below the surface of a nickel-based superalloy as a result of a carburization treatment. The submicron size of the carbide precipitates avoids any detrimental effect on fatigue as they are significantly smaller than other features that could lead to fatigue initiation (e.g., pores, eutectic phases, and cast-in carbides). FIG. 3 represents the effect of a carburization treatment as the elimination of the SRZ 30 and its gamma-prime matrix 32 and gamma and TCP-phase needles 34 beneath the diffusion zone 24 of FIG. 2, and the presence of carbide precipitates 36 within a carburized surface region 38 of the substrate 20 that coincides with or extends beneath the primary diffusion zone 24 of the diffusion coating 22.

Various processes exist for carburizing metal surfaces. Each generally involves the use of a carbon-rich source and an enclosure within which a substrate to be coated can be exposed to carbon atoms made available by the source over a period of time and at a sufficiently elevated temperature to enable the substrate to be enriched with carbon. The composition of the substrate determines the effect of the carburization process. For example, in U.S. Pat. No. 5,702,540, a vacuum gas carburization process is disclosed for carburizing a steel material, in which the carbon source is acetylene gas and the steel material is carburized in a vacuum furnace for the purpose of hardening its surface.

In the context of inhibiting SRZ formation in nickel-based superalloys that undergo a diffusion aluminide coating process, there appears to be a need to accurately and consistently control the depth of carburization. Too little carburization can be inadequate to inhibit SRZ formation, while too much carburization can adversely affect mechanical properties. The nominal carbide layer depth in a nickel-based superalloy protected by a diffusion aluminide coating is believed to approximately coincide with the depth of the aluminum-enriched diffusion zone beneath the coating following application of the coating and subsequent post-coating heat treatments. On this basis, for a diffusion aluminide coating formed by conventional diffusion processes, a preferred carburization depth is believed to be about 25 to about 100 micrometers below the substrate surface. However, in practice it has been difficult to consistently form carburized surface regions in nickel-based superalloys with depths within this range, and particularly with depths that approximately coincide with a known depth of a diffusion zone of a given diffusion coating. The ability to consistently control the carburization depth becomes particularly important for turbine components that have relatively thin walls and cross-sections and are therefore more sensitive to carburization depth variations. Excessive carburization can be particularly problematic at sharp features, such as the trailing edge of an airfoil where carburization occurs from three directions.

BRIEF SUMMARY OF THE INVENTION

The present invention provides a process by which a nickel-based substrate prone to deleterious reactions with an aluminum-rich coating can be stabilized by carburization. The process is particularly effective for use on nickel-based superalloys, and involves a vacuum carburization treatment capable of consistently forming carburized surface regions of controllable depths.

The process generally entails processing the surface of the substrate to be substantially free of oxides, heating the substrate in a non-oxidizing atmosphere to a carburization temperature, and then contacting the surface of the substrate with a carburization gas mixture comprising a diluted low activity hydrocarbon gas while maintaining the substrate at the carburization temperature. While at the carburization temperature and contacted by the carburization gas, carbon atoms in the carburization gas dissociate therefrom, transfer onto the surface of the substrate, diffuse into the substrate, and react with at least one refractory metal within the substrate to form carbides of the refractory metal within a carburized region beneath the surface of the substrate. Thereafter, the substrate is cooled in a non-oxidizing atmosphere to terminate the formation of the carbides in the substrate.

According to this invention, a carburizing process as described above is able to consistently form a carburized surface region in a nickel-based superalloy to a desirable depth, preferably coinciding with the depth of a diffusion zone beneath an aluminum-rich coating subsequently deposited on the substrate surface. The carbides within the carburized surface region serve to tie up refractory metals present in the substrate to inhibit SRZ formation by stabilizing the microstructure of the substrate during and following deposition of the coating.

Other objects and advantages of this invention will be better appreciated from the following detailed description.

BRIEF DESCRIPTION OF THE DRAWINGS

FIG. 1 is a perspective view of a high pressure turbine blade.

FIG. 2 is a schematic representation of a cross-section through a substrate region of a nickel-based superalloy substrate on which a diffusion aluminide coating has been formed, and depicts the subsurface microstructure of the substrate as containing SRZ as a result of or following deposition of the coating.

DETAILED DESCRIPTION OF THE INVENTION

Figure 3:
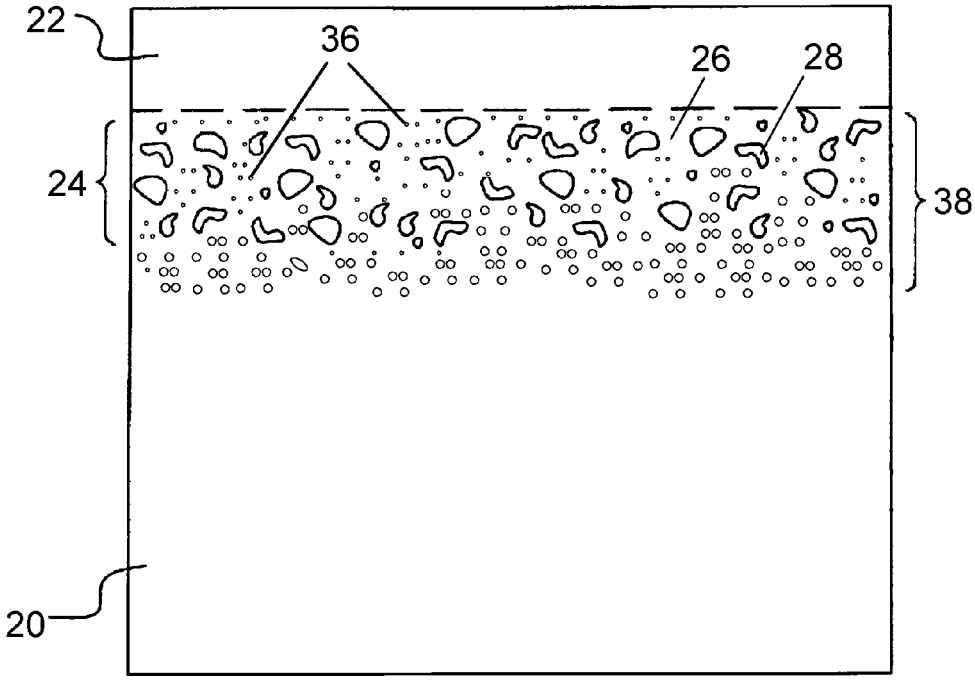
FIG. 3 is a schematic representation of a cross-section through a substrate region corresponding to that of FIG. 2, but depicting the absence of SRZ as a result of the substrate being carburized prior to deposition of the coating.

The present invention is generally applicable to components that operate within environments characterized by relatively high temperatures and subjected to severe thermal and environmental conditions. Notable examples of such components include the high and low pressure turbine nozzles and blades, shrouds, combustor liners, and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to severe attack by oxidation, corrosion, and erosion. While the advantages of this invention will be described with reference to the high pressure turbine blade 10 shown in FIG. 1, the teachings of this invention are generally applicable to any component on which an environmental coating, with or without a thermal barrier coating, may be used to protect the component from its environment.

As a high pressure turbine (HPT), the blade 10 represented in FIG. 1 is typically protected by an environmental coating over which a thermal barrier coating is deposited to provide environmental and thermal protection for the underlying substrate of the blade 10. Suitable materials for the substrate typically include nickel, iron, and cobalt-based superalloys. Of particular interest to this invention are nickel-based superalloys that contain relative high levels of one or more refractory metals, notable examples which include the aforementioned MX4, N6, CMSX-10, CMSX-12, and TMS-75 superalloys, though other alloys are also within the scope of this invention. The MX4 alloy has a nominal composition of, by weight, about 0.4 to about 6.5 percent ruthenium, about 4.5 to about 5.75 percent rhenium, about 5.8 to about 10.7 percent tantalum, about 4.25 to about 17.0 percent cobalt, about 0.9 to about 2.0 percent molybdenum, about 1.25 to about 6.0 percent chromium, up to about 1.0 percent niobium, about 5.0 to about 6.6 percent aluminum, about 3.0 to about 7.5 percent tungsten, up to about 1.0 percent titanium, up to about 0.15 percent hafnium, up to about 0.06 percent carbon, up to about 0.01 percent boron, up to about 0.02 percent yttrium, wherein the sum of molybdenum plus chromium plus niobium is about 2.15 to about 9.0 percent, and wherein the sum of aluminum plus titanium plus tungsten is about 8.0 to about 15.1 percent, the balance nickel and incidental impurities. The N6 alloy has a nominal composition of, by weight, about 10 to about 15 percent cobalt, about 5 to about 6.5 percent tungsten, about 5 to less than 6.25 percent aluminum, about 4.0 to about 6 percent chromium, about 0.5 to about 2.0 percent molybdenum, the combination of Cr+Mo about 4.6 to about 6.5 percent, about 7 to less than 9.25 percent tantalum, about 5.1 to about 5.6 percent rhenium, about 0.1 to about 0.5 percent hafnium, about 0.02 to about 0.07 percent carbon, about 0.003 to about 0.01 boron, up to about 0.03 percent yttrium, up to about 6 percent ruthenium, up to about 1 percent niobium, with the balance nickel and incidental impurities. From these compositions, it can be appreciated that both MX4 and N6 contain significant amounts (e.g., two weight percent or more) of known TCP-forming refractory elements such as rhenium, chromium, tantalum, and tungsten, as well as relatively high levels of other refractory metals such as hafnium, molybdenum, niobium, and zirconium.

Environmental coatings typically applied to HPT blades are aluminum-rich compositions including diffusion coatings such as diffusion aluminides and platinum-modified diffusion aluminides, and overlay coatings such as MCrAlX and nickel aluminide intermetallic. As such, a beneficial aluminum oxide (alumina) scale grows on the coating surface, providing environmental protection for the underlying substrate, inhibiting further oxidation of the coating, and promoting adhesion of the thermal barrier coating (if present). Various materials can be employed as the thermal barrier coating, including zirconia partially or fully stabilized with yttria and/or other oxides. The thermal barrier coating can be deposited by a thermal spray process, a vapor deposition process, or another suitable technique.

Figure 4:
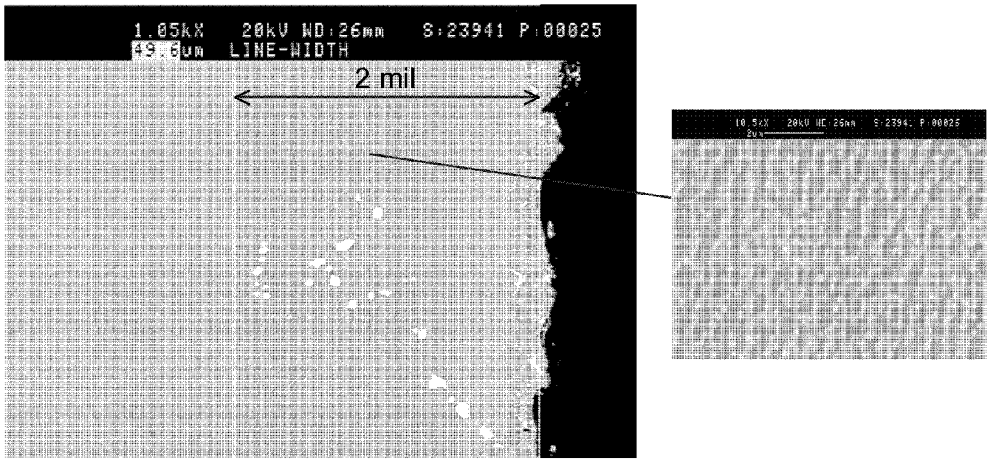
FIG. 4 is a scanning electron microscope (SEM) image showing a carbide-containing layer below the surface of a nickel-based superalloy substrate following a carburization treatment within the scope of the present invention.

While essentially any environmental coating containing aluminum or an aluminide intermetallic is potentially within the scope of this invention, including but not limited to diffusion aluminides, MCrAlX overlay, and beta-phase NiAl overlay coatings, of particular interest are diffusion coatings since the diffusion zone beneath a diffusion coating is much greater than that beneath an overlay coating, and therefore renders the blade substrate more prone to the formation of SRZ. To inhibit SRZ formation, the coating system on the blade 10 includes a carburized region at the surface of the substrate, generally as schematically represented in FIG. 3, shown in FIG. 4, and discussed in the above-noted U.S. Pat. Nos. 5,334,263 and 5,891,267. According to a preferred aspect of the invention, the carburized surface region (e.g., 38 in FIG. 3) contains sufficient carbon at the surface of the substrate to ensure that refractory metals are tied up as carbides, e.g., MC, $M_6C$, and $M_{23}C_6$, rendering the substrate less susceptible to interactions that can lead to the formation of the deleterious SRZ 30 represented in FIG. 2. Depending on the refractory metal content of the substrate, the refractory metal carbides may constitute up to about 40 volume percent, typically about 5 to about 25 volume percent, of the carburized surface region 38, which preferably extends into the substrate a depth that substantially coincides with the depth of the primary diffusion zone of the environmental coating (e.g., the diffusion zone 24 in FIG. 3). Generally, minimum and maximum depths for both the carburized surface region 38 and primary diffusion zone are believed to be about 25 and about 100 micrometers, respectively, though it is foreseeable that lesser and greater depths could be effective depending on the application and the compositions of the coating and substrate. However, the depth of the carbide layer preferably does not exceed about 150 micrometers, more preferably about 100 micrometers, in order to avoid significantly affecting the mechanical properties of the HPT blade 10.

According to the invention, the substrate surface of the blade 10 should undergo appropriately processing prior to forming a carburized zone capable of achieving the above-noted advantages. In particular, the substrate surface should be clean and free of oxides, as surface oxidation will inhibit the desired carburization of the substrate surface. Suitable surface preparation for carburization has been achieved by grit blasting using a combination of adequate pressure and grit size to clean the surface. For example, grit sizes of about 600 to about 80 mesh (about 25 to about 177 micrometers) have been found suitable in combination with pressures of about 40 psi (about 280 kPa), though finer and coarser grit sizes and lower and higher pressures should produce similar effects of cleanliness. In addition, alternate cleaning methods are foreseeable, such as chemical etching and vapor honing techniques capable of producing an essentially oxide-free surface for carburization. An aging heat treatment may be performed prior to surface cleaning if appropriate or desired for the particular substrate alloy.

Following surface cleaning, carburization preferably follows immediately to ensure that the substrate surface remains free of contaminants. Furthermore, handling of the substrate should be conducted in a manner to avoid contamination, and proper surface cleanliness should be maintained while heating the substrate to a carburization temperature, which as used herein indicates a temperature at which carbon atoms will dissociate from a carbon-containing gas, transfer onto the surface of the blade 10, and diffuse into the substrate of the blade 10. For this reason, the blade 10 should be stored (if necessary) in a non-oxidizing environment until transferred to a furnace in which heating of the blade 10 can be conducted in a non-oxidizing environment, such as a vacuum, a hydrogen atmosphere, or a clean and dry inert gas atmosphere. Heating in air is believed to be unacceptable, as the clean substrate surface will oxidize as a result of being contaminated with oxygen. Therefore, after the blade 10 is loaded in the carburizing furnace, the furnace chamber is preferably evacuated, for example, to a level of less than one micrometer Hg (about 0.1 Pa). This vacuum can be maintained while heating to the carburization temperature, which may be, for example, about 1850° F. to about 2100° F. (about 1010° C. to about 1150° C.). Alternatively, the furnace can be backfilled with hydrogen gas to a subatmospheric pressure, for example, about 20 Pa or less, though lower and higher pressures (e.g., 65 Pa or more) are also possible. Once at the carburization temperature, any hydrogen gas is evacuated and the carburization gas is injected into the chamber. According to the process time periods discussed below, the duration of the carburization treatment is timed from the moment the injection of the carburization gas begins (after the blade 10 has been heated to the carburization temperature), and ends when the carburization gas has been purged from the furnace chamber.

Preferred carburization gases are hydrocarbons, including but not limited to acetylene ($C_2H_2$), ethylene ($C_2H_4$), propane ($C_3H_8$), and methane ($CH_4$). The carburization gas may be introduced into the furnace using various techniques. For example, a continuously flowing technique may be used, or a pulsed "boost-diffuse" technique, or a single pulse or injection. Continuous flow of the carburization gas ensures sustained carbon presence at the substrate surface, and has been shown to be successful in investigations leading up to this invention. Alternate gas flow methods may also be acceptable as long as they supply adequate carburization gas to present an effective carbon level at the substrate surface that will ensure carburization of the substrate without depletion of carbon at the substrate surface.

Once the blade 10 reaches the carburization temperature (e.g., about 1850° F. to about 2100° F., as noted above), the hydrocarbon gas is injected into the furnace to make carbon atoms available at the substrate surface. Carbon then deposits on the surface and carbon atoms diffuse below the surface and combine with refractory metal elements in the substrate, with the result that a metallic carbide layer forms below the surface of the blade 10. At the completion of the carburization process, the carburization gas is evacuated from the furnace, a quench gas such as an inert gas (e.g., argon or helium) is preferably injected into the furnace to rapidly cool the blade 10 below a temperature at which carbides will not form in the substrate. While this temperature may depend on the particular carburization gas and substrate material, investigations leading to this invention suggest that a threshold temperature of about 1800° F. (about 980° C.) is a reasonable lower limit for carbide formation in nickel-based superalloys. At the completion of the carburization treatment, the blade 10 is removed from the carburization furnace, after which the blade 10 can undergo any desired or necessary heat treatment and machining, followed by deposition of the desired environmental coating and optional a thermal barrier coating, and then any desired or necessary post-coating heat treatments.

Preliminary investigations using undiluted hydrocarbon gases, including acetylene and propane, were performed in vacuum furnaces on substrate specimens formed of N6 and MX4. However, all such investigations using an undiluted (100% by volume) hydrocarbon gas resulted in excessive carburization to the extent that the process time could not be reliably used to achieve a carbide layer of desired thickness with good repeatability. Furthermore, specimens carburized using an undiluted hydrocarbon gas underwent substantial growth in the thickness of the carbide layer during subsequent elevated temperature exposures, including diffusion coating and heat treatments performed on the specimens.

Figure 5:
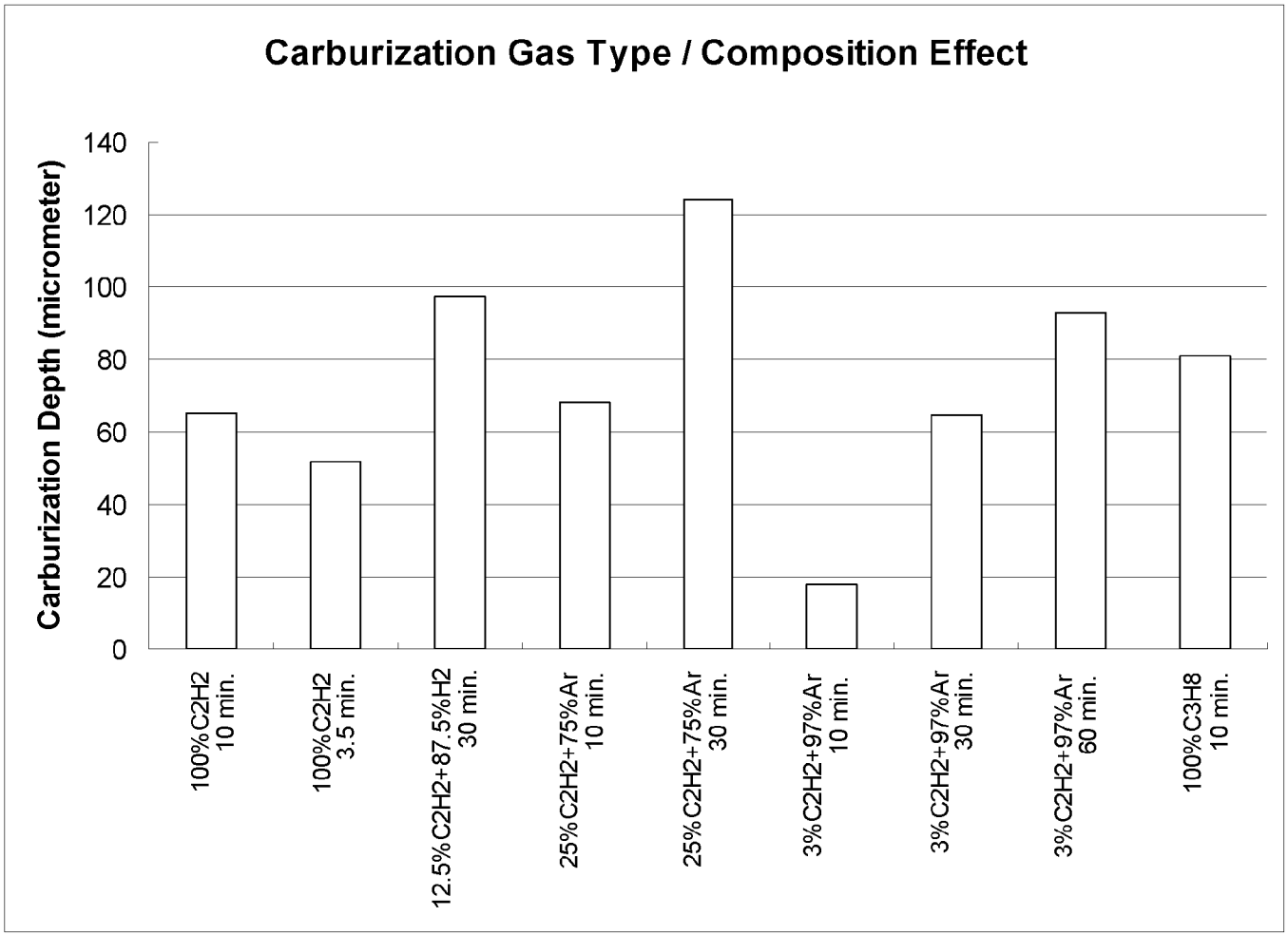
FIG. 5 is a bar chart summarizing carburization depths produced in superalloy specimens using various carburization gases, including low-activity carburization (LAC) gases within the scope of the present invention.

In response, additional investigations were undertaken to limit the depth of carbide layer formation by drastically reducing the activity of the carburization gas. In particular, hydrocarbon gases such as acetylene, ethylene, propane, and methane were diluted with an inert gas or hydrogen. FIG. 5 is a bar chart summarizing the depth of as-carburized carbide layers resulting from various carburization treatments performed on nickel-based superalloy specimens formed of N6 using undiluted and diluted acetylene and propane as the carburization gas. Dilutions are reported in percent by volume. The carburization conditions included a carburization temperature of about 1975° F. (about 1080° C.), treatment durations of about 3.5 to about 60 minutes, a carburization gas pressure of about 2.5 Torr (about 330 Pa), and a carburization gas flow rate of about 400 liters/hour for the first minute and thereafter a flow rate of about 100 liters/hour for the duration of the treatment.

From the results plotted in FIG. 5, it is evident that hydrocarbon gases such as acetylene, if sufficiently diluted, reduced the activity of the carburization treatment to enable treatment duration to be extended, providing a more robust range that can be used as a parameter to accurately and consistently form carbide layers with a desired depth in a nickel-based superalloy. In particular, the investigation showed that concentrations of about 3% (by volume) acetylene and treatment durations of about ten and thirty minutes were able to achieve a desirable and controllable carbide layer thickness at the completion of the carburization treatment.

From the investigations reported above, it was concluded that the carburization temperature and duration are interrelated and that, as a result of using a sufficiently diluted, low-activity carburization gas in accordance with this invention, both temperature and duration can be adjusted to control the depth of a carbide layer. Carburization temperature will be a function of the desired carbide layer depth and the carburizing source. Previous research had indicated the requirement for a carburization temperature about 2000° F. (about 1095° C.) and above 1900° F. (about 1035° C.) if undiluted methane or undiluted acetylene, respectfully, is used as the carburization gas. In investigations subsequent to those reported above, a carburization temperature of about 1975° F. (about 1080° C.) was successfully evaluated when using diluted acetylene as the carburization gas. For preferred low activity carburization gases such as diluted acetylene, the preferred range for the carburization temperature is believed to be about 1900° F. to about 2000° F. (about 1035° C. to about 1095° C.). It is worth noting at this point that conventional carburization temperatures used with steels are not high enough to produce carbide layers in nickel-based superalloys.

As previously stated, the duration of the carburization process of this invention is preferably measured as the period commencing with the introduction of the carburization gas into the furnace, and ends when the carburization gas has been purged from the furnace. In the investigations leading to this invention, durations of about 10 to about 60 minutes were successfully used with low activity carburization gases in which a hydrocarbon gas was diluted to constitute less than 25 volume percent of the carburization gas. While it should be understood that carburization duration is a function of the carburization temperature, the carburization gas, and the desired carbide layer depth, preferred durations are believed to be about 1 to about 120 minutes for a gas mixture containing acetylene, ethylene, methane, and/or propane diluted to about 0.1 volume percent to about 10 volume percent of the gas mixture.

To consistently obtained the advantageous results reported above, those skilled in the art will appreciate that, in addition to controlling dilution and treatment duration, several other operating parameters should be controlled to yield a desired carbide layer thickness. For example, the flow rate of the carburization gas should be maintained at a level sufficient to ensure that carbon atoms are available and present at the substrate surface for diffusing into the substrate. A range of flow rates is believed to be acceptable as long as there is an overabundance of carbon at the article surface. In the investigations reported above, carburization gas flow rates of about 100 liters/hour were successful within a chamber having a volume of about twelve cubic feet (about 350 liters). Though preferred flow rates will be dependent on the particular carburization gas used, the geometry of the furnace chamber, the number and size of articles being coated, and the desired carbide layer depth, it is believed that suitable flow rates for the gas mixture are in a range of about 25 to about 1000 liters/hour. The pressure within the carburization furnace (the gas mixture pressure) is also believed to be a result-effective parameter, with preferred pressures being in a range of about 1 to about 10 Torr to reduce or avoid sooting.

Gamma prime precipitate-strengthened nickel-based superalloys benefit from being heat treated to cause precipitation of the beneficial gamma prime strengthening phases. Such heat treatments to precipitate gamma prime or other beneficial phases can be applied before or after the carburization treatment of this invention. However, it is believed that such heat treatments are not necessary to obtain the beneficial effect of carbide formation to eliminate SRZ in accordance with the process of this invention. Furthermore, many components formed of nickel-based superalloys may require various manufacturing processing steps after the carburization step of this invention. For example, in addition to coating and heat treatments, some form of drilling, grinding, shot peening, etc., may be desirable or necessary. The carburized layer produced by this invention does not appear to interfere with any of these traditional manufacturing processes. Finally, it should be noted that the carburized nickel-based superalloy specimens of the investigations reported above experienced local increases in hardness at their carburized surfaces, with hardnesses increasing from initial values of about 40-45 Rc to about 55-60 Rc. While unintended, such increases may have beneficial side effects.

While our invention has been described in terms of a preferred embodiment, it is apparent that other forms could be adopted by one skilled in the art. Accordingly, the scope of our invention is to be limited only by the following claims.

The invention claimed is:

1. A process for carburizing a nickel-based superalloy substrate prior to depositing an aluminum-containing coating on a surface thereof so as to stabilize the substrate and inhibit formation of a secondary reaction zone during and following deposition of the coating, the process comprising the steps of:

processing the surface of the substrate to be substantially free of oxides;

heating the substrate in a non-oxidizing atmosphere to a carburization temperature;

contacting the surface of the substrate with a carburization gas mixture comprising a diluted hydrocarbon gas while maintaining the substrate at the carburization temperature for a duration of less than 60 minutes so as to cause carbon atoms in the carburization gas to dissociate therefrom, transfer onto the surface of the substrate, diffuse into the substrate, and react with at least one refractory metal within the substrate to form carbides of the at least one refractory metal, the gas mixture comprising about 3 volume percent of the hydrocarbon gas and the balance essentially an inert gas and/or hydrogen, the hydrocarbon gas being at least one chosen from the group consisting of acetylene, ethylene, methane, and propane, the carbides being within a carburized region beneath the surface of the substrate; and then cooling the substrate in a non-oxidizing atmosphere to terminate the formation of the carbides in the substrate.

2. The process according to claim 1, wherein the gas mixture is flowed over the substrate at a flow rate of about 25 to about 1000 liters/hour.

3. The process according to claim 1, wherein the gas mixture is at a pressure of about 1 to about 10 Torr.

4. The process according to claim 1, wherein the gas mixture is continuously flowed over the surface of the substrate.

5. The process according to claim 1, wherein the gas mixture is discontinuously flowed over the surface of the substrate.

6. The process according to claim 1, wherein the carburized region extends not more than 150 micrometers below the surface of the substrate.

7. The process according to claim 1, wherein the carburized region extends about 25 to about 100 micrometers below the surface of the substrate.

8. The process according to claim 1, wherein the carbides constitute up to about 40 volume percent of the carburized region.

9. The process according to claim 1, wherein the carbides constitute about 5 to about 25 volume percent of the carburized region.

10. The process according to claim 1, further comprising the step of depositing the aluminum-containing coating on the surface of the substrate, wherein the aluminum-containing coating is an overlay coating, a diffusion aluminide coating, or a platinum group metal-modified diffusion aluminide coating.

11. The process according to claim 10, further comprising the step of forming a ceramic thermal barrier coating on the aluminum-containing coating.

12. A process for depositing an aluminum-containing diffusion coating on a surface of a nickel-based superalloy substrate containing at least one refractory metal chosen from the group consisting of rhenium, chromium, tantalum, and tungsten, the process comprising the steps of:

processing the surface of the substrate to be substantially free of oxides;

heating the substrate in a non-oxidizing atmosphere to a carburization temperature of about 1010° C. to about 1150° C.;

contacting the surface of the substrate with a carburization gas mixture while maintaining the substrate at the carburization temperature for a duration of up to about 30 minutes so as to cause carbon atoms in the carburization gas to dissociate therefrom, transfer onto the surface of the substrate, diffuse into the substrate, and react with at least one refractory metal of the nickel-based superalloy to form carbides of the at least one refractory metal, the gas mixture consisting essentially of an inert gas and/or hydrogen and about 3 volume percent of a hydrocarbon gas chosen from the group consisting of acetylene, ethylene, methane, and propane, the carbides being within a carburized surface region of the substrate beneath the surface of the substrate;

cooling the substrate in a non-oxidizing atmosphere to terminate the formation of the carbides in the substrate; and then depositing the aluminum-containing diffusion coating on the surface of the substrate, wherein the carburized surface region substantially coincides with a diffusion zone of the diffusion coating and extends not more than 150 micrometers below the surface of the substrate, and the carburized surface region stabilizes the substrate and inhibits formation of a secondary reaction zone during and following deposition of the diffusion coating.

* * * * *